United States Patent [19]

Kosky et al.

[11] 4,011,535

[45] Mar. 8, 1977

[54] VAPORIZATION COOLED TRANSFORMER

[75] Inventors: Philip G. Kosky, Bethlehem, Pa.; Heinz Jaster, Schenectady, N.Y.

[73] Assignee: General Electric Company, Schenectady, N.Y.

[22] Filed: July 9, 1976

[21] Appl. No.: 703,859

[52] U.S. Cl. ..... 336/57; 165/105; 174/15 R; 336/60

[51] Int. Cl.[2] ..... H01E 27/10

[58] Field of Search ..... 336/55, 57, 58, 60, 336/61; 174/15 R, 15 C, 16 R, 16 BH; 165/105

[56] References Cited

UNITED STATES PATENTS 3,024,298 3/1962 Goltsos et al. ..... 336/58 X

*Primary Examiner*—Thomas J. Kozma
*Attorney, Agent, or Firm*—Paul R. Webb, II; Joseph T. Cohen; Jerome C. Squillaro

[57] ABSTRACT

A vaporization cooled transformer includes an improved liquid distribution system which distributes the dielectric or cooling liquid in a predetermined fashion for liquid film flow over the wall surfaces of vertical cooling ducts with minimal liquid hold-up.

6 Claims, 4 Drawing Figures

VAPORIZATION COOLED TRANSFORMER

This invention relates to vaporization cooled transformers, and more particularly, to such transformers with an improved liquid distribution system.

Closed, or hermetically sealed, film evaporation cooling systems employing two-phase fluid coolants have been proposed. In such systems the fluid coolant is distributed while in its liquid phase as a liquid film over a surface, or surfaces, of the apparatus to be cooled. Heat transfer from the heated surface of the apparatus to the liquid film evaporates the film thereby cooling the surface and the apparatus. Where the apparatus to be cooled is electrical in nature, such as, a transformer, the two-phase fluid coolant is a dielectric and, sometimes, an inert non-condensable dielectric gas is used in addition to the two-phase fluid. The inert noncondensable gas serves to maintain adequate system pressure and dielectric strength. In the above film evaporation cooling system, the vapor produced subsequently condenses and is redistributed as a liquid film over the surfaces of the apparatus to be cooled. The evaporation-condensation cycle causes a natural recirculation of the coolant. However, it has been found that the flowing liquid coolant cannot normally be maintained intact on smooth surfaces unless substantial liquid coolant is caused to flow in addition to the above-discussed natural recirculation rate. If the rupture of the liquid film occurs, then large dry and therefore hot spots are formed on the surfaces to be cooled resulting in undesirably high temperatures. To reduce this undesirable situation, either excess liquid may be pumped to the cooling surfaces in addition to the condensate flow, or the apparatus to be cooled may be partially submerged in a pool of the liquid coolant.

In U.S. Pat. No. 3,887,759 an evaporative cooling system is described which employs liquid film evaporation from grooved evaporator surface and a condensate make-up pump for circulating liquid. A perforated drip pan is shown as the liquid distribution means which is positioned above the heat producing electrical apparatus. The condensate make-up pump pumps additional liquid to the pan. This patent is assigned to the same assignee as the present application.

The primary object of our invention is to provide a vaporization cooled transformer with an improved liquid distribution system.

In accordance with one aspect of the invention, a vaporization cooled transformer includes an improved liquid distribution system which distributes the dielectric or cooling liquid in a predetermined fashion for liquid film flow over the wall surfaces of vertical cooling ducts with minimal liquid hold-up.

These and various objects, features and advantages will be understood from the following descriptions taken in connection with the accompanying drawing in which.

Figure 1:
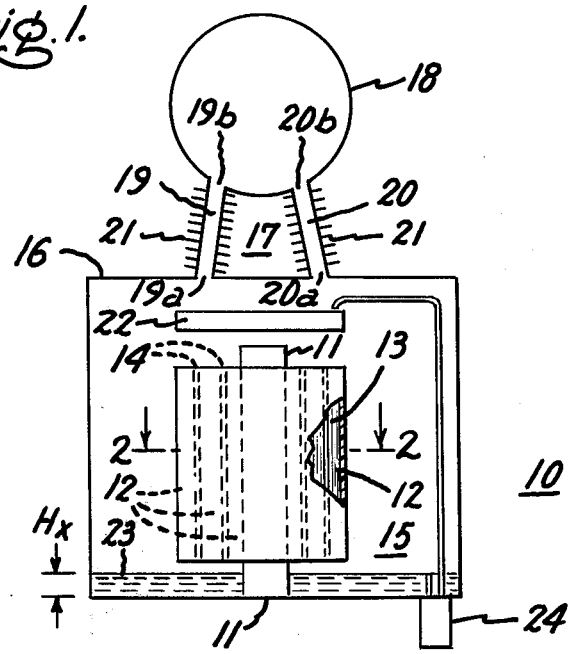
FIG. 1 is a schematic view of a vaporization cooled transformer made in accordance with our invention.

In FIG. 1 of the drawing, there is shown generally at 10, a vaporization cooled transformer made in accordance with our invention. Transformer 10 includes a core 11 of laminated magnetic steel on which there are disposed a number of conductor windings 12 embedded in an epoxy resin 13 and have a plurality of vertical ducts 14 therethrough. The cooling surfaces of conductor windings 12 are the walls of vertical ducts 14 which are placed at several radial and circumferential positions of windings 12. Core 11 and epoxy embedded windings 12 may be mounted on a suitable pedestal (not shown) of dielectric material within a casing. Core 11 and windings 12 are located within a vaporization chamber 15 of a transformer casing 16. A surface condenser 17 is coupled in series between chamber 15 of casing 16 and a gas-holding reservoir 18. The system including vaporization chamber 15, condenser 17 and gas-holding reservoir 18, form a closed or a hermetically sealed system. The system is charged with a mass of vaporizable dielectric liquid such as inert fluorocarbon, e.g., perfluoro-2-butyltetra-hydrofuran. The system is also charged with an inert non-condensible dielectric gas such as sulfur hexafluoride ($SF_6$). The fluorocarbon liquid coolant has a high dielectric strength. However, the dielectric strength of its vapor varies directly with its density. Accordingly, at low system temperatures when the vapor density is low, little dielectric protection is provided. Accordingly, a predetermined amount of non-condensable inert dielectric gas is charged into the system to regulate the system pressure for the purpose of maintaining the dielectric strength in the vapor phase in chamber 15 when the system temperature is low. It is to be understood that the aforementioned inert fluorocarbon liquid coolant and inert gas are specifically named herein as examples and that other liquid coolants and inert non-condensable gas may be employed.

Condenser 17 is illustrated as an air-cooled surface condenser comprising a plurality of condenser tubes, such as the tubes 19 and 20. Each of the tubes 19 and 20 may be provided with spaced cooling fins 21 which are connected to the outer wall surfaces of the tubes and, as is well known, such cooling fins promote heat transfer from the tubes. Tube 19 is open at both ends, **19*a* and 19*b*; the opening 19*a* serves as a vapor as well as a condensate outlet port. As indicated, the tube opening 19*a* is coupled to and communicates with the top of the vaporization chamber 15. The tube opening 19*b* is coupled to and communicates with the gas-holding reservoir 18. Similarly, condenser tube 20 is open at both ends, 20*a* and 20*b*. The opening 20*a* serves as both a vapor inlet and condensate outlet port and is coupled to and communicates with the top of the vaporization chamber 15. The tube opening 20*b* is coupled to and communicates with the gas reservoir 18. However, in a large transformer, a more compact design is effected by replacing the said reservoir 18 by a high pressure gas storage tank with is fed by a pressure initiated signal to a small compressor which pumps on a small header common to the condenser tube ends 19*b* and 20*b*. As required, the gas may be bled back into the main transformer 10 by a pressure signal directed towards an automatic valve in flow communication with the vaporization chamber 15. There is mounted within vaporization chamber 15 near the top thereof and situated directly below the tube openings 19*a* and 20*a* an improved liquid distribution pan 22 which is arranged to receive condensate exiting from the openings 19*a*** and 20*a* of the surface condenser 17. Improved distribution pan 22 enables condensate collected therein to be distributed as a liquid film over the wall surfaces of vertical coolings ducts 14 of the embedded windings 12. The excess liquid collects in a pool 23 or body of liquid in the bottom of vaporization chamber 15. Pool 23 of liquid coolant, having the liquid level $H_x$ measured from the bottom of the chamber 15 of casing 16 includes the bottom portion of the core 11 immersed therein.

Two condenser tubes 19 and 20 of surface condenser 17 have been shown diagrammatically. However, it is to be understood that more than, or less than, two condenser tubes may be employed for connecting the vaporization chamber 15 with the gas holding reservoir 18, depending on the heat transfer rate required for the specific purpose. As, for example, at median ambient design temperatures, the vaporizable dielectric liquid coolant pool 23 fills the bottom portion of vaporization chamber 15 of casing 16 to the level $H_x$ as indicated. Heat produced by the transformer 10 vaporizes the liquid film thereby cooling the transformer. The vapor moves upwardly in the vaporization chamber 15 and enters the condenser 17 through the inlet openings 19*a* and 20*a*. The non-condensable dielectric gas is normally largely confined in reservoir 18 if its vapor density is less than that of the dielectric vapor. The dielectric gas in effect, closes off the opposite ends 19*b* and 20*b* of the condenser tubes 19 and 20. With ends 19*b* and 20*b* closed by the gas, the vapor moves upwardly in the tubes 19 and 20 and condenses on the inner wall surfaces of these tubes. The condensate, thus formed, on the inner wall surfaces of the tubes 19 and 20 flows downwardly and ultimately exits as a liquid condensate from the openings 19*a* and 20*a* and collects in distribution pan 22. From pan 22, the condensate is distributed over the wall surfaces of vertical ducts 14. Thus, the condensate formed in the condenser tubes returns by gravity, in countercurrent flow relationship with the vapor in the tubes, to pan 22, where again by means of gravity, it is distributed on the wall surfaces of vertical ducts 14 as a film. Subsequently, the heat producing transformer 10 again vaporizes the liquid film thereby rejecting its heat. This vaporization-condensation cycle is repeated and the temperature of the transformer 10 is maintained within safe operating limits. There is also located within vaporization chamber 15 a condensate make-up pump 24 for recirculating condensate from pool 23 of the body of liquid back to pan 22. The inclusion of condensate make-up pump 24, such as, for example, a vapor push pump, is advantageous. Vapor push pumps are described, for example, in U.S. Pat. Nos. 3,819,301 and 3,834,835, both of which patents are assigned the same assignee as this application. Without such a pump 24 to recirculate the condensate from pool 23 to pan 22, the only liquid return is by the process of vaporization and subsequent condensation cycle. In such a situation, a large mass of the transformer windings to be cooled must then be immersed in liquid 23.

Figure 2:
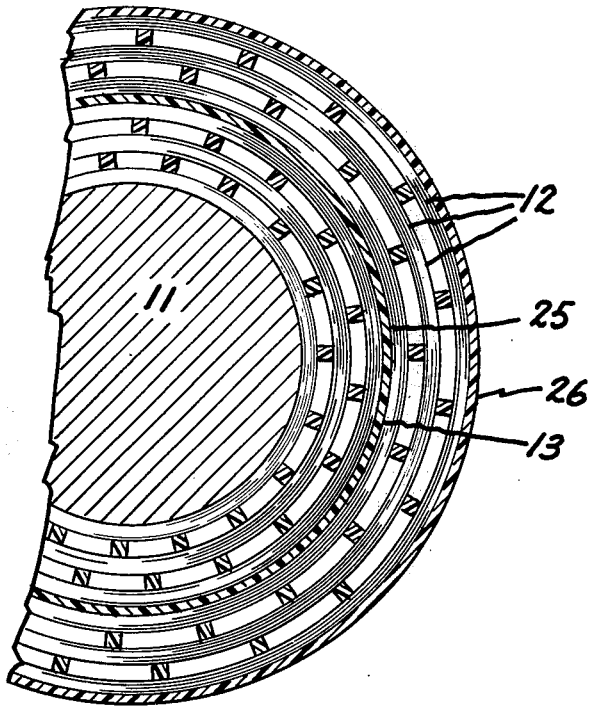
FIG. 2 is a sectional view taken on section line 2—2 of FIG. 1.

In FIG. 2 of the drawing, there is a sectional view taken on section line 2—2 of FIG. 1 showing in more detail core 11 of laminated magnetic steel around on which there is disposed a number of conductor windings 12 embedded in epoxy resin 13. A plurality of vertical ducts for cooling are placed at several radial and circumferential positions of embedded conductor windings 12. A layer of epoxy-glass fiber 25 is positioned between the low voltage windings and the high voltage windings. A layer of epoxy-glass 26 covers the exterior surface of the high voltage windings.

Figure 3:
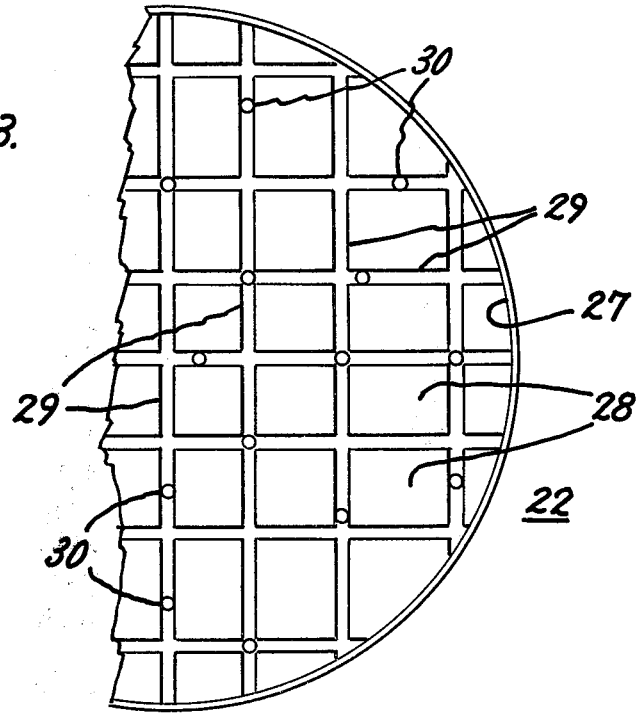
FIG. 3 is a top plan view of a portion of the liquid distribution pan which is shown in FIG. 1 of the drawing.

In FIG. 3 of the drawing there is shown a top plan view of a portion of liquid distribution pan 22 illustrated in FIG. 1 of the drawing. Pan 22 has an outer rim 27 providing a container for condensate from both condenser 17 and pump 24. Pan 22 has a number of segments 28 positioned below the upper edge of rim 27 to form a distribution head which segments 28 are bounded by a plurality of interconnected grooves 29. A number of nozzles 30 are spaced nonuniformly from grooves 29 and extend outwardly from the bottom of pan 22 to provide a uniform flow of dielectric liquid to the wall surfaces of vertical ducts 14 in embedded conductor windings 12. The function of grooves 29 is to provide containment for a head of dielectric liquid while minimizing the volume of liquid held up. Grooves 29 are relatively deep so that a small tilt in pan 22 containing liquid will not cause a relatively high percentage change in this liquid head as would occur in a shallow pan. Furthermore, as opposed to the present invention, a deep pan of full open cross section would cause hold-up of an unacceptable large volume of liquid. Present distribution pan 22 with deep grooves 29 transfers the liquid head requirements without excessive hold-up of the liquid. The number and size of nozzles 30 is so chosen to deliver a certain fraction of the total liquid flow on certain portions of the upper surface of the embedded conductor windings.

Figure 4:
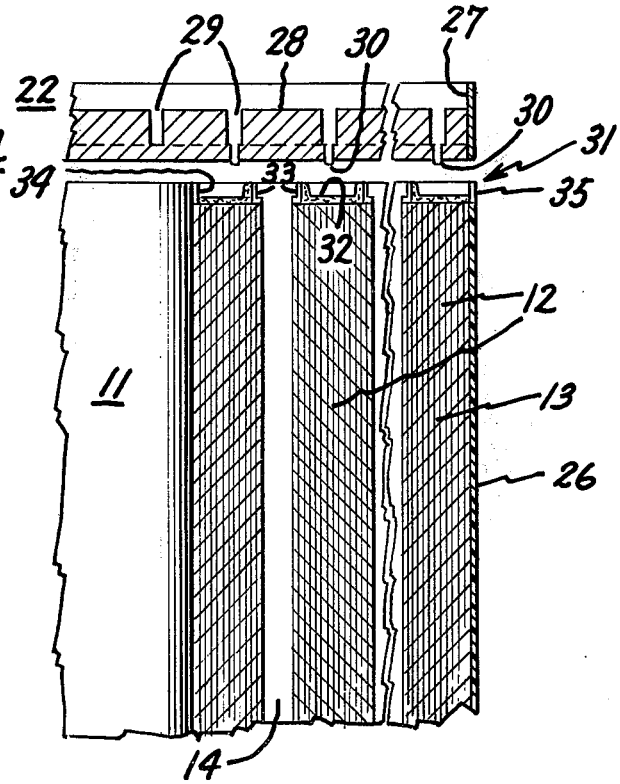
FIG. 4 is an elevations view partially in section of the liquid distribution system of the vaporization cooled transformer shown in FIG. 1 of the drawing.

In FIG. 4 of the drawing there is shown a partial elevational view of a broken away section of the liquid distribution system of the vaporization cooled transformer shown in FIG. 1 of the drawing. Core 11 is shown as surrounded by three segments of conductor windings 12 embedded in epoxy resin 13 and having vertical ducts 14. A position of distribution pan 22 shown in FIGS. 1 and 3 of the drawing is positioned above and supported in any suitable manner over core 11 and embedded conductor windings 12. Along the upper edges of each embedded conductor windings 12 segment, there is provided a dam 31 for liquid which comprises a piece 32 of felt or other wicking material held in position by pins or other fastening elements 33 resulting in a central recess portion and outer raised portions. Additionally, a strip of material 34, such as plastic, is wound around the upper inner edge of the first conductor winding segment between core 11 and the first conductor winding segment. A similar strip of material 35 is wound around the upper outer edge of the outermost conductor winding segment to contain liquid. Such materials 34 and 35 extend above the edge of the conductor winding segments completing the dam structure. As it will be noted, nozzles 30 of pan 22 are positioned selectively so that their exit ends are in an alignment with the reaccessed portions of the felt material 32 on each segment of conductor windings. The number and sizes of nozzles are positioned so that as not to cause grooves 29 of pan 22 to overflow the maximum total flow rates. The condensate liquid in pan 22 flows into grooves 29 and exits through nozzles 30 onto the associated felt material 32 on the conductor winding segments. The liquid is lifted over the edges of the dams by the wicking action of material 32 and flows downward wetting with a uniform film the surfaces of vertical ducts 14 which are the heat transfer surfaces of these windings. Felt coated dams 31 are further advantageous in reducing any tilt effect which would otherwise cause liquid to flow preferentially to one side of the transformer vertical ducts to be cooled by such a liquid film.

While the above description of our invention sets forth a preferred improved liquid distribution system within a vaporization cooled transformer, it will be appreciated that other changes and modifications can be employed within the scope of this invention. The present vaporization cooled transformer provides a liquid distribution pan for containing a head of dielectric liquid while minimizing the volume of liquid hold-up, a liquid dam system associated with the distribution pan to receive liquid from the pan in a uniform manner, the dam system providing a film flow of liquid over the wall surfaces of the vertical ducts of the embedded windings to provide uniform cooling, and a condensate make-up pump to provide additional liquid to the distribution pan. In this manner, substantially uniform cooling is provided for the vaporization cooled transformer. Other distribution pan designs can be employed provided they minimize the volume of liquid hold-up while providing suitable containment for a head of dielectric liquid. Other liquid dam arrangements can be successfully employed if they produce a uniform liquid film on the cool surfaces of the embedded conductors during the cooling of the surfaces. While a condensate make-up pump produces a more desirable cooling arrangement for the transformer, other means of supplying liquid to the distribution pan can be employed.

While other modifications of the invention and variations thereof which may be employed within the scope of the invention have not been distributed, the invention is intended to include such as may be embraced within the following claims:

What we claim as new and desire to secure by Letters Patent of the United States is:

1. A hermetically sealed vaporization chamber containing heat producing electrical apparatus to be cooled while dielectrically protected and two phase dielectric fluid comprising a liquid and a vapor, said apparatus including a plurality of cooling ducts extending vertically therethrough, said liquid residing at a bottom portion of the chamber and having a liquid level above the bottom of the chamber, said liquid also being distributed as a film which coats the wall surfaces of the vertical ducts, said vapor being produced by vaporization of said liquid by said heat produced by said apparatus, said vapor occupying space in said chamber above said liquid level, a condenser having one end thereof connected to and communicating with an upper portion of said vaporization chamber occupied by said vapor, a reservoir containing a predetermined mass of non-condensable dielectric gas positioned above said condenser, said condenser having another end connected to and communicating with said reservoir and said gas therein, said gas forming an interfacial contact with said vapor in said condenser at a region therein between said ends of said condenser, said vapor condensing to form liquid condensate in the condenser on one said interfacial contact so that the effective condensation area of said condenser lies between said one end of said condenser and said interfacial contact; distribution means in said chamber positioned above said electrical apparatus for receiving liquid condensate from said condenser, a liquid dam positioned on the upper edges of the apparatus adjacent the associated vertical ducts, the distribution means distributing the liquid condensate uniformly to the liquid dam, the liquid dam distributing the liquid condensate uniformly as a film over the wall surfaces of the adjacent vertical ducts, and a condensate make-up pump for pumping liquid from the bottom portion of the chamber to said distribution means.

2. A hermetically sealed vaporization chamber as in claim 1, in which the electrical apparatus is a vaporization cooled transformer including a core, a plurality of epoxy embedded conductor windings surrounding the core and having a plurality of vertical ducts therethrough; and the liquid dam is positioned on the upper edges of the epoxy embedded conductor windings adjacent the associated vertical ducts.

3. A hermetically sealed vaporization chamber as in claim 1, in which the liquid dam comprises wicking material.

4. A hermetically sealed vaporization chamber as in claim 3, in which the liquid dam has a central recessed portion and outer raised portions.

5. A hermetically sealed vaporization chamber as in claim 1, in which the distribution means comprises a distribution pan with an outer rim, a plurality of segments forming a distribution head, a plurality of interconnected grooves bounding the segments, and a number of nozzles extending from the grooves and spaced nonuniformly on the bottom of the pan to distribute the liquid condensate uniformly to the liquid dam.

6. A hermetically sealed vaporization chamber containing a vaporization cooled transformer to be cooled while dielectrically protected and two phase dielectric fluid comprising a liquid and a vapor, said transformer including a plurality of cooling ducts extending vertically therethrough, said liquid residing at a bottom portion of the chamber and having a liquid level above the bottom of the chamber, said liquid also being distributed as a film which coats the wall surfaces of the vertical ducts, said vapor being produced by vaporization of said liquid by said heat produced by said apparatus, said vapor occupying space in said chamber above said liquid level, a condenser having one end thereof connected to and communicating with an upper portion of said vaporization chamber occupied by said vapor, a reservoir containing a predetermined mass of non-condensable dielectric gas positioned above said condenser, said condenser having another end connected to and communicating with said reservoir and said gas therein, said gas forming an interfacial contact with said vapor in said condenser at a region therein between said ends of said condenser, said vapor condensing to form liquid condensate in the condenser on one said interfacial contact so that the effective condensation area of said condenser lies between said one end of said condenser and said interfacial contact; distribution means in said chamber positioned above said electrical apparatus for receiving liquid condensate from said condenser, said distribution means comprising a distribution pan with an outer rim, a plurality of segments forming a distribution head, a plurality of interconnected grooves bounding the segments, and a number of nozzles extending from the grooves and spaced nonuniformly on the bottom of the pan, a liquid dam positioned on the upper edges of the apparatus adjacent to the associated vertical ducts, said liquid dam comprising wicking material with a central recessed portion and outer raised portions, nozzles of the distribution pan distributing the liquid condensate uniformly to the liquid dam, the liquid dam distributing the liquid condensate uniformly as a film over the wall surfaces of the adjacent vertical ducts, and a condensate make-up pump for pumping liquid from the bottom portion of the chamber to said distribution means.

* * * * *